US006121851A

United States Patent [19]

Takane et al.

[11] Patent Number: 6,121,851

[45] Date of Patent: Sep. 19, 2000

[54] NON-RECIPROCAL CIRCUIT ELEMENT

[75] Inventors: Shinji Takane; Ryouji Matsumoto, both of Saitama-ken, Japan

[73] Assignee: Hitachi Metals Ltd., Tokyo, Japan

[21] Appl. No.: 09/172,035

[22] Filed: Oct. 14, 1998

[30] Foreign Application Priority Data

| | | | |
|---|---|---|---|
| Oct. 15, 1997 | [JP] | Japan | 9-282353 |
| Nov. 27, 1997 | [JP] | Japan | 9-326812 |
| Aug. 4, 1998 | [JP] | Japan | 10-220125 |

[51] Int. Cl.[7] ..... H01P 1/383; H01P 1/36

[52] U.S. Cl. ..... 333/1.1; 333/24.2

[58] Field of Search ..... 333/1.1, 24.2

[56] References Cited

U.S. PATENT DOCUMENTS

| | | | |
|---|---|---|---|
| 3,334,318 | 8/1967 | Nakahara et al. | 333/1.1 |
| 4,812,787 | 3/1989 | Kuramoto et al. | 333/1.1 |
| 5,068,629 | 11/1991 | Nishikawa et al. | 333/1.1 |

FOREIGN PATENT DOCUMENTS

| | | |
|---|---|---|
| 5-80008 | 10/1993 | Japan . |
| 06061708 | 3/1994 | Japan . |
| 8-8612 | 1/1996 | Japan . |

*Primary Examiner*—Paul Gensler
*Attorney, Agent, or Firm*—Finnegan, Henderson, Farabow, Garrett & Dunner

[57] ABSTRACT

A non-reciprocal circuit element for transmitting a high-frequency signal of microwave band in one direction. The electrical characteristics of the non-reciprocal circuit element have been improved by using an insulating sheet having a thickness within a specific range thereby to regulate the distance between vertically adjacent strip electrodes within a specific range. Also, the product-to-product variation in the electrical characteristics of the non-reciprocal circuit element has been minimized by shaping the end portion of the strip electrode so as to extend in coplanar relationship to the top surface of the capacitor to be connected.

19 Claims, 4 Drawing Sheets

NON-RECIPROCAL CIRCUIT ELEMENT

BACKGROUND OF THE INVENTION

The present invention relates to a non-reciprocal circuit element for use in high-frequency electrical parts for microwave band.

The non-reciprocal circuit element is utilized in a transmitting circuit of a mobile communication apparatus such as a cellular radiotelephone and an automobile radiotelephone to transmit microwave signal in only one direction. Recent demand for a mobile communication apparatus with a reduced size and a higher performance requires to reduce the size and enhance the performance of the non-reciprocal circuit element itself. To meet such a demand, a non-reciprocal circuit element of concentrated constant type has become widely used because it may be easily reduced in size.

The non-reciprocal circuit element includes an isolator and an circulator, each having a basic structure practically the same as each other. An exploded view of the respective elements constituting an isolator of concentrated constant type is shown in FIG. 5. A resin case 7 is fitted in a lower yoke 6 made of a thin plate of an electrically conductive, ferromagnetic material. A conductor assembly 4, capacitors C1, C2, C3 and a resistor R are mounted in place in the resin case 7, and electrically connected. A magnet 9 for applying DC magnetic field to the conductor assembly 4, a resin mold 5 for keeping the magnet 9 in position, and an upper yoke 8 for forming a magnetic circuit are mounted as shown in FIG. 5. Finally, the upper yoke 8 is connected to the lower yoke 6 to obtain the isolator.

The conductor assembly 4, the most important portion of the isolator, is shown in FIGS. 6(*a*) and 6(*b*) in more detail. As seen from FIG. 6(*a*), the conductor assembly 4 comprises a shield disk 2 being connected to a ground electrode, three strip electrodes 21, 22, 23 radially extending from the shield disk 2 at 120-degree angles, a ferrite disk 1 and insulating sheets 3, 3. The ferrite disk 1 is put on the shield disk 2, and then three strip electrodes 21, 22, 23 are bent as shown in FIG. 6(*b*). Specifically, each of the strip electrodes 21, 22, 23 is bent inwardly along the contour of the ferrite disk 1 so as to surround the ferrite disk 1. The bent strip electrodes cross each other at the center of the top surface of the ferrite disk 1 while electrically insulated to each other by the insulating sheets 3, 3 disposed between adjacent bent strip electrodes. After mounted into the resin case 7, the ends of the bent strip electrodes 21, 22, 23 are respectively connected to an inlet/outlet port P1, P2 and the resistor R in the resin case 7 through a matching circuit comprising a capacitor, etc. For example, as shown in FIG. 6(*b*), the bent strip electrode 21 is connected to the port P1 through a capacitor C1, the bent strip electrode 22 is connected to the port P2 through a capacitor C2, and the bent strip electrode 23 is connected to the resistor R through a capacitor C3.

A microwave signal input to the port P1 creates a high-frequency magnetic field around the strip electrode 21. The high-frequency magnetic field is rotated at a predetermined angle by the interaction with the DC magnetic field from the magnet 9 to induce a microwave signal in the strip electrode 22 clockwise adjacent to the strip electrode 21 by an inductive coupling through the ferrite disk 1. The induced microwave signal is transmitted to the port P2. When a reflected wave of the microwave signal being output from the port P2 is input reversely to the port P2, the reversely input signal induces a microwave signal in the strip electrode 23 clockwise adjacent to the strip electrode 22, the induced microwave signal being absorbed by the resistor R. In this manner, the isolator transmits the microwave signals only in one direction. A circulator is obtained by connecting the strip electrode 23 to another input/output port in place of the resistor R.

To meet the demand for an isolator with a reduced size and a reduced thickness, a conventional isolator of 7 mm square and about 3 mm in thickness has been further miniaturized to a size of 5 mm square and about 2 mm in thickness. The effort for reducing the size and thickness and improving the performance of the conductor assembly 4 has been directed to optimizing the material and reducing the size of the main parts such as the ferrite disk 1, shield disk 2 and the strip electrodes 21, 22, 23 because these parts determine the size of the conductor assembly 4. The effort has been further directed to minimizing the variation in the crossing angle between the bent strip electrodes to improve the electrical characteristics.

For example, Japanese Patent Laid-Open No. 8-8612 discloses a non-reciprocal circuit element characterized in that the conductor assembly is constructed by laminating a plurality of insulating films each having thereon a strip electrode so that the strip electrodes cross at a predetermined angle. It is reported that, with such a laminating, the crossed structure of the strip electrodes can be easily obtained and that the variation in the crossing angle between the strip electrodes is minimized to prevent the electrical properties of the non-reciprocal circuit element from being deteriorated.

Japanese Utility Model Laid-Open No. 5-80008 teaches that the miniaturization of the non-reciprocal circuit element requires both the ferrite disk and the strip electrodes to be reduced in their thickness. This prior art document further teaches that thinner strip electrodes are quite difficult to provide a bent structure with a predetermined crossing angle, thereby to reduce the productivity and result in the deterioration of the electrical properties and the product-to-product variation in the electrical properties. To eliminate the problems, the document discloses a non-reciprocal circuit element characterized in that the strip electrodes are bent onto respective insulating sheets having tacky or adhesive nature to fix the strip electrodes at a predetermined crossing angle.

However, it has been still demanded to further improve the electrical properties of the non-reciprocal circuit element and further reduce the product-to-product variation in the electrical properties.

OBJECT AND SUMMARY OF THE INVENTION

Accordingly, an object of the present invention is to provide a miniature non-reciprocal circuit element improved in the electrical properties, particularly in the insertion loss, isolation and return loss with a minimized product-to-product variation in the electrical properties.

During the intense research in view of the above objects, the inventors have paid attention to the thickness of the insulating sheet for insulating the strip electrodes, i.e., the distance between the bent strip electrodes. The thickness or the distance has been little studied in the art and the reports relating to the influence of the thickness or the distance on the electrical properties are rarely found in the art.

The insulating sheet has been hitherto recognized in the art to make little contribution to reducing the thickness of the conductor assembly because the thickness is as sufficiently small as 0.1 mm or less. Also, the insulating sheet is not considered to directly affect the properties of the non-reciprocal circuit element. Therefore, the insulating sheet available from a manufacturer has been used merely making into account the easiness of handling or assembling.

During the study on the influence of the thickness of the insulating sheet on the properties of the non-reciprocal circuit element, it has been found by the inventors that the electrical properties of the non-reciprocal circuit element are further improved with decreasing thickness of the insulating sheet because the distance between the top surface of the ferrite disk and the bent strip electrodes is reduced, although the insulation between the bent strip electrodes becomes insufficient. The strip electrodes and the insulating sheet therebetween act just as a capacitor. When the insulating sheet is made thinner, the vertically adjacent strip electrodes are electrostatically connected to likely cause the leakage of the microwave signals from one of the vertically adjacent strip electrodes to the other. Therefore, the insulation between the bent strip electrodes should be made while considering the influence on the electrical properties. As a result, the inventors have found that a thickness of the insulating sheet or a distance between the bent strip electrodes within a specific range further improves the electrical properties of the non-reciprocal circuit element.

The inventors have further paid attention to, to minimize the product-to-product variation in the electrical properties, the positional relationship between the end portions of the bent strip electrodes and the top surface of the capacitors to be connected to the bent strip electrodes and the positional relationship between the bent strip electrodes and the top surface of the ferrite disk in view of making the inductance constant while assuming the bent strip electrode as a coil. Since the conventional conductor assembly has a construction mentioned above, the contact of the strip electrodes with the top surface of the ferrite disk and the positional relationship between the ferrite disk and the end portion of each bent strip electrode are not necessarily constant among the conductor assemblies.

For example, the bent strip electrode is connected to the capacitor by applying a solder paste on the top surface of the capacitor, then closely press-contacting the end portion of the bent strip electrode extending horizontally from the ferrite disk with the top surface of the capacitor through the solder paste while bending the strip electrode downward by the pressure from the resin mold, and finally reflowing the solder paste. Since the capacitor is usually small in its height as compared with the conductor assembly, the end portion of the bent strip electrode extends horizontally over the top surface of the capacitor.

Further, three bent strip electrodes extend horizontally at different heights. Namely, the first bent strip electrode extends at a height of the same level as the top surface of the ferrite disk. The second bent strip electrode extends horizontally at a height higher than that of the first bent strip electrode by the total of the thickness of the first bent strip electrode and the thickness of the insulating sheet. Similary, the third bent strip electrode extends horizontally at a height higher than that of the second bent strip electrode.

The difference in height between the end portion of the bent strip electrode and the top surface of the capacitor produces an adverse effect on the electrical properties. As shown in FIG. 7 with solid lines and broken lines, when the positional relationship between the resin mold 5 and the conductor assembly 4 is changed, the position at which the bent strip electrode 21 is pressed onto the top surface of the capacitor C1 is shifted to change the shape of the end portion of the strip electrode 21. This changes the contact condition of the strip electrode 21 with the top or side surface of the ferrite disk 1 to change the inductance of the strip electrode 21 assumed as a coil. The same disadvantage occurs in connecting the other bent strip electrodes to the respective capacitors. Also, the same problem is found between the bent strip electrodes extending at different heights. As a result of intense search, the inventors have further found that the above problem can be eliminated by making the end portion of the bent strip electrode extending coplanarly with the top surface of the capacitor being connected to the strip electrode.

Thus, in a first preferred embodiment of the present invention, there is provided a non-reciprocal circuit element for transmitting a high-frequency signal of microwave band in one direction, comprising: (1) a conductor assembly comprising a ferrite disk put on a shield disk being grounded and a plurality of strip electrodes disposed so as to extend horizontally on the top surface of the ferrite disk, one end of each strip electrode being connected to the shield disk, and the plurality of strip electrodes crossing each other at the same crossing angles at a center of the top surface of the ferrite disk and being insulated each other by an insulating sheet disposed between vertically adjacent strip electrodes; (2) a magnet disposed so as to apply DC magnetic field to the ferrite disk in an axial direction thereof; (3) a plurality of capacitors, each being connected to the other end of each strip electrode; and (4) an upper yoke and a lower yoke for receiving therein the conductor assembly, the magnet and the plurality of capacitors; wherein the insulating sheet used for insulating the plurality of strip electrodes comprises a substrate having a thickness of larger than 12.5 $\mu$m and not larger than 65 $\mu$m and an optional adhesive layer, a total thickness of the insulating sheet being larger than 25 $\mu$m and not larger than 65 $\mu$m.

In a second preferred embodiment of the present invention, there is provided a non-reciprocal circuit element for transmitting a high-frequency signal of microwave band in one direction, comprising: (1) a conductor assembly comprising a ferrite disk put on a shield disk being grounded and a plurality of strip electrodes disposed so as to extend horizontally on the top surface of the ferrite disk, one end of each strip electrode being connected to the shield disk, and the plurality of strip electrodes crossing each other at the same crossing angles at a center of the top surface of the ferrite disk and being insulated each other by an insulating sheet disposed between vertically adjacent strip electrodes; (2) a magnet disposed so as to apply DC magnetic field to the ferrite disk in an axial direction thereof; (3) a plurality of capacitors, each being connected to the other end of each strip electrode; and (4) an upper yoke and a lower yoke for receiving therein the conductor assembly, the magnet and the plurality of capacitors; wherein a distance between any of vertically adjacent strip electrodes is larger than 12.5 $\mu$m and not larger than 65 $\mu$m at the crossing portion of the strip electrodes.

The distance between the vertically adjacent strip electrodes in the conductor assembly is basically determined by the thickness of the insulating sheet disposed therebetween. As described above, the total thickness of the insulating sheet used for insulating the strip electrodes is larger than 25 $\mu$m and not larger than 65 $\mu$m. Therefore, just after disposing the insulating sheet between the strip electrodes, the distance is also larger than 25 $\mu$m and not larger than 65 $\mu$m at least in the crossing portion of the strip electrodes. However, the total thickness of the insulating sheet, when the insulating sheet is an adhesive type, may be reduced during the assembly. For example, the adhesive layer is reduced in its thickness during a subsequent step of reflowing a solder paste to connect the strip electrodes to the capacitors because the adhesive layer is softened or melted due to the heating. For this reason, in some cases of using the adhesive insulating sheet, the lower limit of the distance between the vertically adjacent strip electrodes in the assembled conductor assembly is smaller than the lower limit of the original total thickness of the insulating sheet being used. Since the substrate of the insulating sheet has a thickness of larger than 12.5 μm, the lower limit of the distance between the vertically adjacent strip electrodes in the assembled conductor assembly is also 12.5 μm. The distance is preferably 15–50 μm, and more preferably 25–45 μm.

In a third preferred embodiment of the present invention, there is provided a non-reciprocal circuit element for transmitting a high-frequency signal of microwave band in one direction, comprising: (1) a conductor assembly comprising a ferrite disk put on a shield disk being grounded and a plurality of strip electrodes disposed so as to extend horizontally on the top surface of the ferrite disk, one end of each strip electrode being connected to the shield disk, and the plurality of strip electrodes crossing each other at the same crossing angles at a center of the top surface of the ferrite disk and being insulated each other by an insulating sheet disposed between vertically adjacent strip electrodes; (2) a magnet disposed so as to apply DC magnetic field to the ferrite disk in an axial direction thereof; (3) a plurality of capacitors, each being connected to the other end of each strip electrode; and (4) an upper yoke and a lower yoke for receiving therein the conductor assembly, the magnet and the plurality of capacitors; wherein an end portion of each strip electrode extends horizontally with the lower surface thereof in coplanar relationship to the top surface of the capacitor to be connected.

In the third preferred embodiment, the total thickness of the insulating sheet to be used is preferably larger than 25 μm and not larger than 65 μm and the thickness of the substrate is preferably larger than 12.5 μm and not larger than 65 μm. Also, the distance between any of vertically adjacent strip electrodes is preferably larger than 12.5 μm and not larger than 65 μm at the crossing portion.

In the third preferred embodiment, the strip electrode extending along the top surface of the ferrite disk may be bent downward at the periphery of the top surface, and then, the strip electrode extending downward in contact with the circumferential side surface of the ferrite disk may be bent so that the end portion to be connected to the capacitor extends horizontally with the lower surface thereof in coplanar relationship to the top surface of the capacitor. The coplanar relationship can be easily and accurately attained by notching the strip electrode at a position at which the strip electrode is bent so as to extend horizontally.

Alternatively, in the third preferred embodiment, the coplanar relationship may be attained by disposing the capacitor so as to make the top surface thereof in coplanar relationship to the lower surface of the horizontally extending strip electrode along the top surface of the ferrite disk.

In the above preferred embodiments, the insulating sheet may be adhesive and comprises a resin substrate and optionally an adhesive layer. The adhesive insulating sheet may be double-coated type or single-coated type. The total thickness of the insulating sheet is larger than 25 μm and not larger than 60 μm, preferably 30 to 50 μm, and more preferably 35 to 45 μm. The substrate is usually made of a resin such as polyimide and has a thickness of larger than 12.5 μm and not larger than 60 μm, preferably 15–50 μm, and more preferably 25–45 μm. The adhesive layer is made of a material known in the art. The adhesive insulating sheet may be disposed on the uppermost strip electrode bent onto the top surface of the ferrite disk in addition to being disposed between the adjacent strip electrodes.

The non-reciprocal circuit element of the present invention includes an isolator and a circulator. The isolator having the characteristic features described above has an insertion loss of 0.45 dB or less, preferably 0.32 dB or less in terms of absolute value, an isolation of 18 dB or more, preferably 20 dB or more in terms of absolute value, and a refection loss of 17 dB or more, preferably 18 dB or more in terms of absolute value. In particular, more preferable electrical characteristics may be obtained when using an insulating sheet having a total thickness of 35–45 μm.

BRIEF DESCRIPTION OF THE DRAWINGS

FIG. 1(*b*) is a schematic illustration showing a conductor assembly of the present invention assembled as shown in FIG. 1(*a*);

FIG. 2(*b*) is a schematic illustration showing the connection of a bent strip electrode of the conductor assembly of FIG. 2(*a*) to the top surface of a capacitor;

DETAILED DESCRIPTION OF THE PREFERRED EMBODIMENT

Figure 1A:
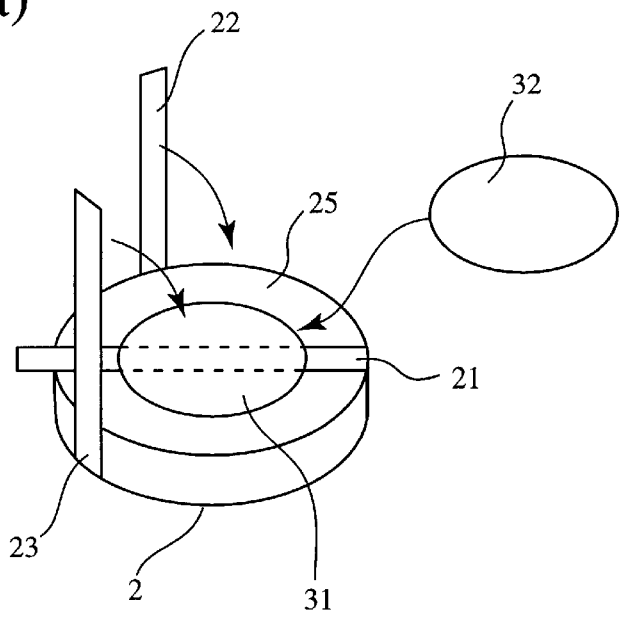
FIG. 1(*a*) is a schematic illustration showing the respective elements constituting a conductor assembly of the present invention.

The present invention will be described below more in detail while referring to the drawings in which like reference numerals indicate like parts.

PREFERRED EMBODIMENT 1

The non-reciprocal circuit element of the present invention will be described taking an isolator as an example. First, referring to FIG. 1(*a*), the assembly of the respective elements to the conductor assembly will be described.

Figure 1B:
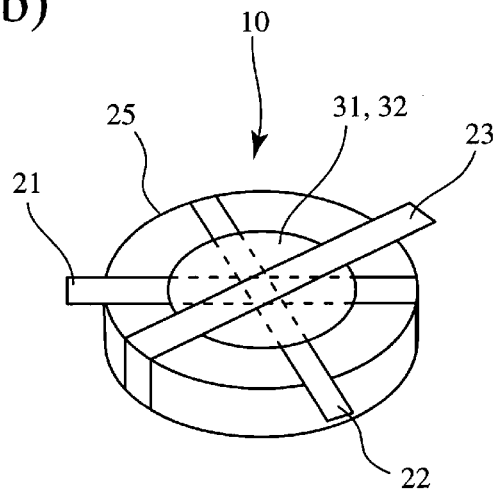

A garnet disk 25 is disposed on a shield disk 2. Garnet is a ferrite in a broad sense and a suitable ferritic material for the isolator. The shield disk 2 has three strip electrodes 21, 22, 23 which are integrally formed with the shield disk 2 and extend radially at 120-degree angle. First, for example, the strip electrode 21 is bent upward at the periphery of the bottom surface of the garnet disk 25 so as to extend upward in contact with the circumferential surface of the garnet disk 25. Then, the strip electrode 21 is bent inward at the periphery of the top surface of the garnet disk 25 so as to extend horizontally in contact with the top surface of the garnet disk 25. An insulating sheet 31 is disposed on the bent strip electrode 21. The strip electrode 22 is then bent in the same manner as above, on which an insulating sheet 32 is disposed. The insulating sheets 31, 32 have a diameter smaller than that of the garnet disk 25 and are preferably made of a highly heat-resistant material to avoid the change in property and the deformation due to the heating in the subsequent step. A polyimide adhesive insulating sheet is preferably used. Finally, the strip electrode 23 is bent in the same manner as above. An insulating sheet may be further disposed on the last-bent strip electrode 23. A conductor assembly 10 assembled in the manner as described is shown in FIG. 1(*b*). The isolator of the present invention is assembled from the conductor assembly 10 in a manner known in the art, for example, in the manner mentioned above referring to FIGS. 6(*a*) and 6(*b*).

In the same manner as above, five types of isolator (Samples 1 to 5), 20 isolators for each type, were produced while changing the total thickness of the insulating sheets as shown in Table 1. The garnet disk 25 used was 3.9 mm in diameter and 0.45 mm in thickness. As the insulating sheets, adhesive insulating sheets (diameter: 3.4 mm) having a substrate made of polyimide were used. During the assembly of the conductor assembly 10, each of the strip electrodes was closely contacted with each adhesive insulating sheet so as to avoid a gap from being present between the strip electrode and the adhesive insulating sheet. An adhesive insulating sheet was further disposed on the last-bent strip electrode so as to prevent the variation in the crossing angles between the bent strip electrodes and minimize the influence of the factors other than the thickness of the insulating sheet on the electrical characteristics of the isolator.

The insertion loss, the isolation and the return loss of the isolators were measured at 1.441 GHz by Network Analyzer 8753D manufactured by Hewlett-Packard Company. The averaged values of 20 isolators for each type are shown in Table 1 together with the variance represented by 3σ(σ: standard deviation) and the lower limit of variance average +3σ for insertion loss, and average −3σ for each of isolation, return loss (in), and return loss (out), in absolute value. Also, the reference values in terms of absolute values for each of measured electrical characteristics are shown in parentheses.

The insertion loss is a ratio of the output voltage V2 from the output terminal to the input voltage V1 into the input terminal. The ratio was calculated from the following equation: 20×log (V2/V1) and represented by dB. An insertion loss smaller, in absolute value, than the reference value of 0.45 dB was judged as good.

The isolation is a ratio of the output voltage V4 from the input terminal to the input voltage V3 into the output terminal. The ratio was calculated from the following equation: 20×log (V4/V3) and represented by dB. An isolation, in absolute value, greater than or equal to the reference value of 18 dB was judged as good.

The return loss (in), a return loss at the input side, is a ratio of the return voltage V1r from the circuit element to the input voltage V1 into the input terminal. The ratio was calculated from the following equation: −20×log (V1r/V1) and represented by dB. A return loss (in) larger than the reference value of 17 dB was judged as good. The return loss (in) correlates to the voltage standing wave ratio (VSWR) calculated from the equation: $(1+|\Gamma|)/(1-|\Gamma|)$ the return coefficient Γ being represented by V1r/V1.

The return loss (out), a return loss at the output side, is a ratio of the return voltage V3r from the circuit element to the input voltage V3 into the output terminal. The ratio was calculated from the following equation: −20×log (V3r/V3) and represented by dB. A return loss (out) larger than the reference value of 17 dB was judged as good. The return loss (out) also correlates to VSWR as in the case of the return loss (in).

The above reference values are those widely used in the art for evaluating the electrical characteristics of isolators.

TABLE 1

| | Sample 1 | Sample 2 | Sample 3 | Sample 4 | Sample 5 |
|---|---|---|---|---|---|
| Thickness of insulating sheet (μm) | | | | | |
| total | 25 | 35 | 45 | 60 | 65 |
| substrate | 12.5 | 25 | 25 | 25 | 25 |
| Insertion loss (≦0.45 dB) | | | | | |
| average | 0.44 | 0.23 | 0.24 | 0.27 | 0.27 |
| 3σ | 0.20 | 0.02 | 0.02 | 0.05 | 0.05 |
| average + 3σ | 0.64 | 0.25 | 0.26 | 0.32 | 0.32 |
| Isolation (≧18 dB) | | | | | |
| average | 11.70 | 33.30 | 25.30 | 30.30 | 27.70 |
| 3σ | 5.73 | 4.60 | 5.24 | 13.86 | 22.52 |
| average − 3σ | 5.97 | 28.70 | 20.06 | 16.44 | 5.18 |
| Return loss (in) (≧17 dB) | | | | | |
| average | 14.70 | 28.30 | 23.70 | 19.70 | 20.00 |
| 3σ | 6.24 | 2.73 | 4.82 | 8.66 | 15.20 |
| average − 3σ | 8.46 | 25.57 | 18.88 | 11.04 | 4.80 |
| Return loss (out) (≧17 dB) | | | | | |
| average | 14.30 | 27.30 | 25.72 | 21.30 | 23.3 |
| 3σ | 4.58 | 3.24 | 4.93 | 12.12 | 19.97 |
| average − 3σ | 9.72 | 24.06 | 20.79 | 9.18 | 3.33 |
| Evaluation | poor | supreme | excellent | good | fair |

Sample 1 was sufficient only in the insertion loss, and poor in the other measured characteristics. Also, the lower limit of variance was out side the reference value range in any of the measured characteristics.

Samples 2 and 3 satisfied the reference value ranges in any of the measured characteristics with respect to both the average values and the lower limit of variances, and in particular, Sample 2 showed supreme results.

Sample 4 satisfied the reference value range in any of the measured characteristics with respect to the average value. The lower limit of the variance wasout side the reference value range with respect to the isolation and the return loss. Since the lower limit of variance of the isolation was only slightly out side the reference value range, Sample 4 showed totally good results.

Sample 5 satisfied the reference value range in any of the measured characteristics with respect to the average value. Therefore, although the lower limit of variance was outside the reference value range with respect to the isolation and the return loss, Sample 5 showed totally fair results.

As seen from the results, the insulating sheet having a total thickness of 25 μm (thickness of substrate: 12.5 μm) exhibited poor results (Sample 1). However, supreme results were obtained when using the insulating sheet having a total thickness of 35 μm (Sample 2). This showed that a critical total thickness appeared in the range of 25–35 μm. As a result of repeated experiments, it was confirmed that a total thickness of 30 μm produced good results as compared with a total thickness of 25 μm.

Further, it can be seen that good results were obtained when using the insulating sheet having a total thickness of 35–65 μm, and excellent results were obtained when using the insulating sheet having a total thickness of 35–45 μm. It is evident from the results that a total thickness of larger than 25 μm and not larger than 65 μm, preferably 30–50 μm, more preferably 35–45 μm improves the electrical characteristics of the isolator. A total thickness of 30–60 μm is practically sufficient when the improvement in the insertion loss and the isolation is particularly intended.

PREFERRED EMBODIMENT 2

Figure 2A:
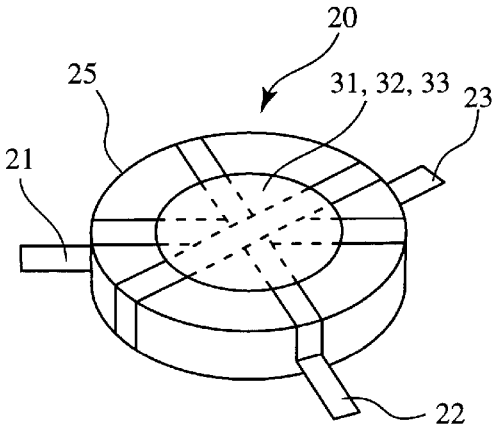
FIG. 2(*a*) is a schematic illustration showing another conductor assembly of the present invention.
Figure 2B:
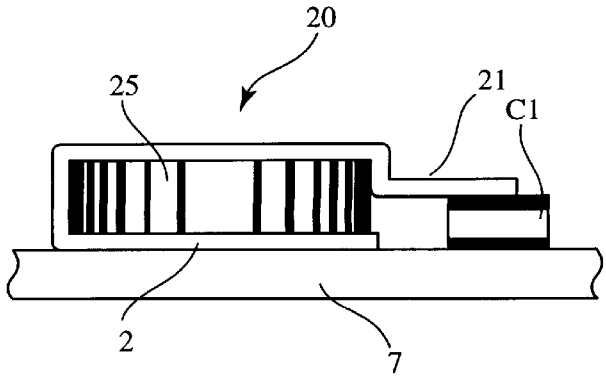
Figure 3A:
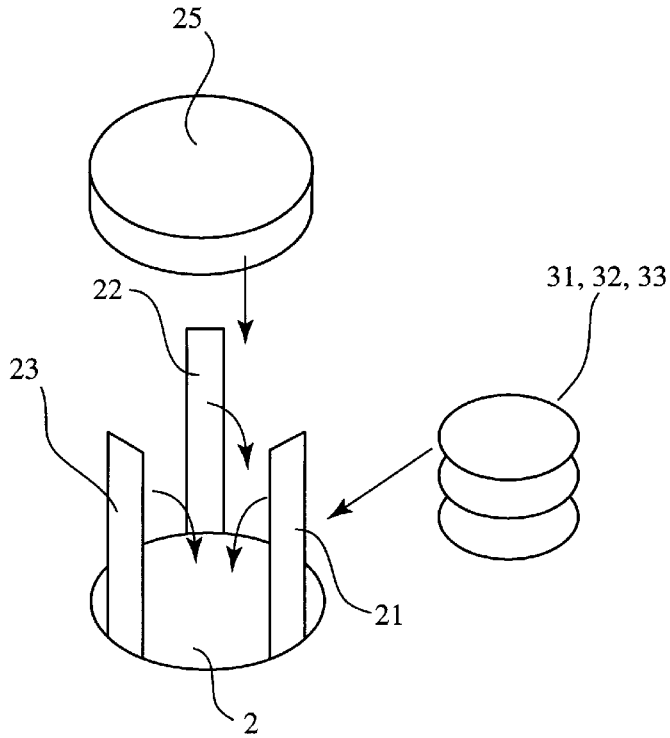
FIGS. 3(*a*) and 3(*b*) are schematic illustrations showing the respective elements and the construction of the conductor assembly shown in FIG. 2(*a*)
Figure 3B:
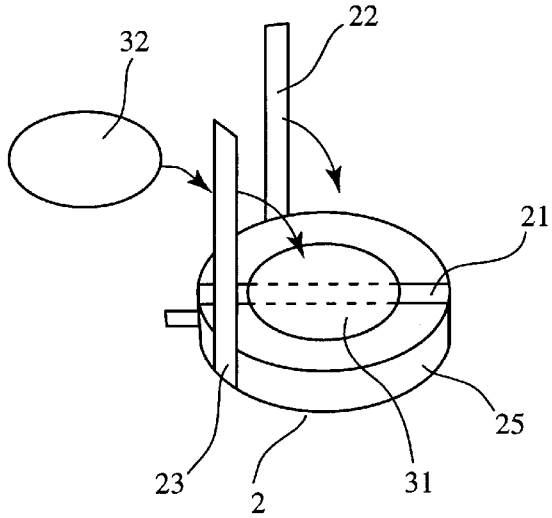

FIG. 2(*a*) shows a conductor assembly 20 of another preferred embodiment of the present invention, and FIG. 2(*b*) shows a connection between the end portion of a strip electrode 21 and a capacitor C1. FIGS. 3(*a*) and 3(*b*) show the assembly of the conductor assembly 20.

Referring to FIG. 3(*a*), a garnet disk 25 is put on a shield disk 2 from which strip electrodes 21, 22, 23, integral parts of the shield disk 2, extend radially. Then, one of the strip electrodes, for example, the strip electrode 21 is bent at the periphery of the bottom surface of the garnet disk 25 so as to extend upward in contact with the circumferential surface of the garnet disk 25, and then further bent inside at the periphery of the top surface of the garnet disk 25 so as to extend horizontally in contact with the top surface of the garnet disk 25 while passing the center of the top surface thereof, as shown in FIG. 3(*b*). Next, the end portion of the bent strip electrode 21 is bent at the periphery of the top surface of the garnet disk 25 so as to extend downward in contact with the circumferential surface of the garnet disk 25, and finally, bent at about 90-degree angle so as to extend horizontally. The final bending is made so that the lower surface of the end portion extending horizontally is in coplanar relationship to the top surface of the capacitor C1 to be connected thereto as shown in FIG. 2(*b*). Then, an insulating sheet 31, for example, an adhesive polyimide circular sheet, is disposed on the bent strip electrode 21 so as to closely fix it onto the top surface of the garnet disk 25. The strip electrode 22 is then bent in the same manner as described above, and an insulating sheet 32 is disposed thereon. Finally, the strip electrode 23 is bent in the same manner as described above, and an insulating sheet 33, which may be omitted, is disposed thereon to obtain the conductor assembly 20 as shown in FIG. 2(*a*).

Figure 4:
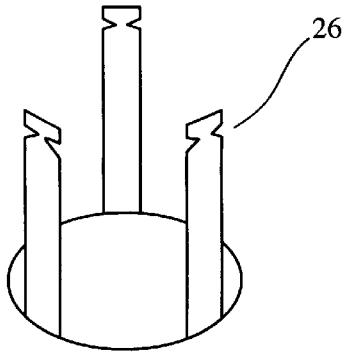
FIG. 4 is a schematic illustration showing notched strip electrodes of the present invention.
Figure 5:
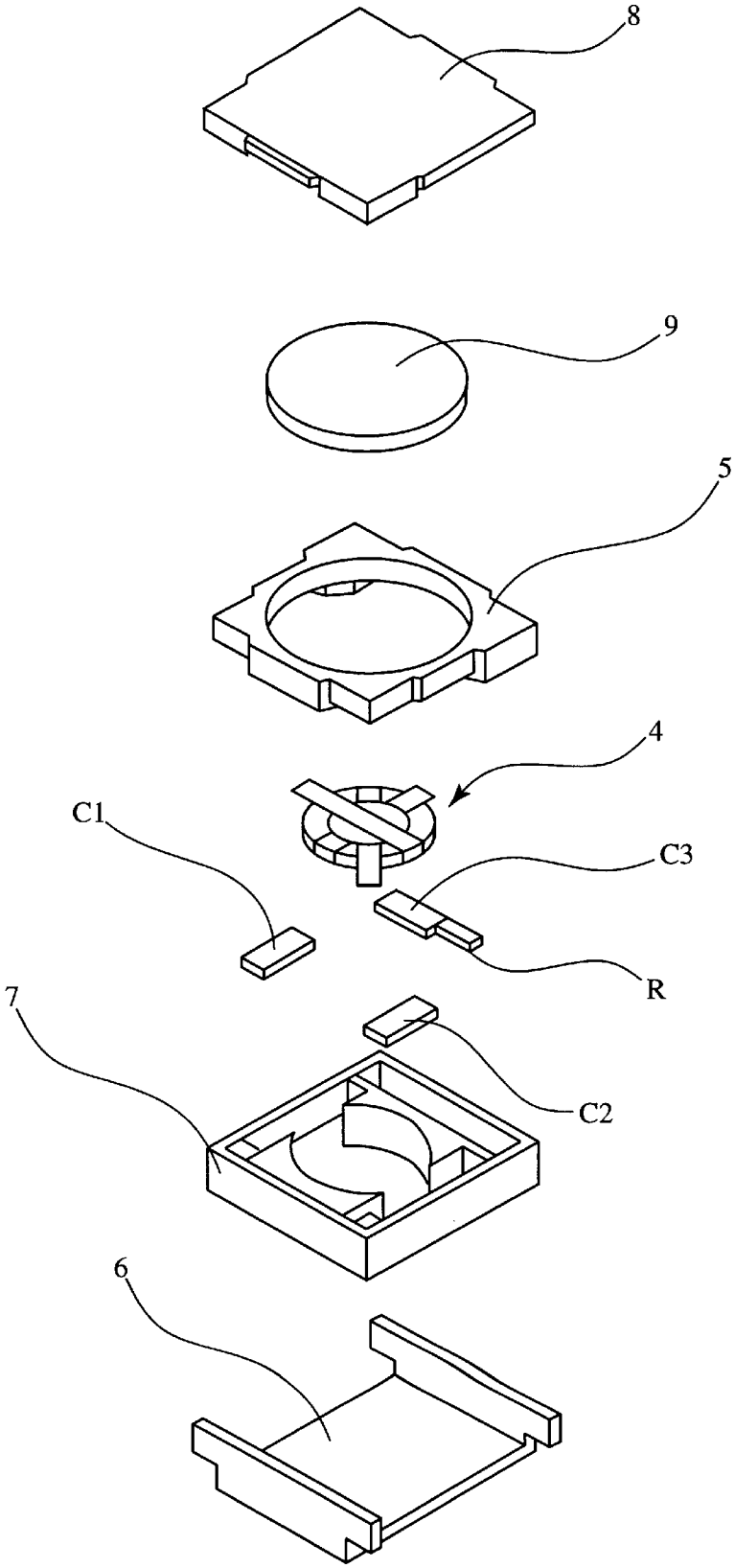
FIG. 5 PRIOR ART
FIG. 5 is an exploded view showing respective elements of an isolator of concentrated constant type.

The bending of the end portions of the bent strip electrodes may be done in any other stages of assembly, for example, after each disposition of the insulating sheet on the bent strip electrode, or after disposing all the insulating sheets. The bending portion at which the end portion of the bent strip electrode is finally bent to extend horizontally may be suitably determined depending on the height of the top surface of the capacitor to be connected thereto while considering the difference in the height between the bent strip electrodes. To facilitate the final bending and ensure the coplanar relationship between the lower surface of the horizontally extending strip electrode and the top surface of the capacitor to be connected thereto, a notch 26 is preferably made at the bending portion as shown in FIG. 4.

The conductor assembly 20 thus assembled is then electrically connected to the capacitors C1 to C3 and the resistor R in the resin case 7. The resin case 7 has a recessed around electrode which receives the conductor assembly 20. The shield disk 2 is soldered to the ground electrode. The capacitors C1 to C3 and the resistor R are received by respective rectangular recessed electrodes, and one of the terminals thereof is soldered to the respective recessed electrodes. Input/output terminals P1 and P2 connected to the respective recessed electrodes for the capacitors C1 and C2 are formed on the bottom surface of the resin case 7.

The horizontally extending end portions of the bent strip electrodes 21, 22, 23 are respectively soldered to the capacitors C1, C2, C3. As a result, the strip electrodes 21, 22 are respectively connected to the ports P1, P2 through the matching circuits each including capacitor C1 or C2, and the strip electrode 23 is connected to the resistor R through the matching circuit comprising the capacitor C3. Thus, each of the strip electrodes 21, 22, 23 is wound around the garnet disk 25 in contact with the circumferential surface and the top surface of the garnet disk 25, thereby to obtain a longer contact length between each strip electrode and the garnet disk 25. With the above bending method, the product-to-product variation in the contact length can be reduced. Therefore, the inductance of the strip electrodes is made constant between the products to minimize the product-to-product variation in the electrical characteristics.

Figure 6A:
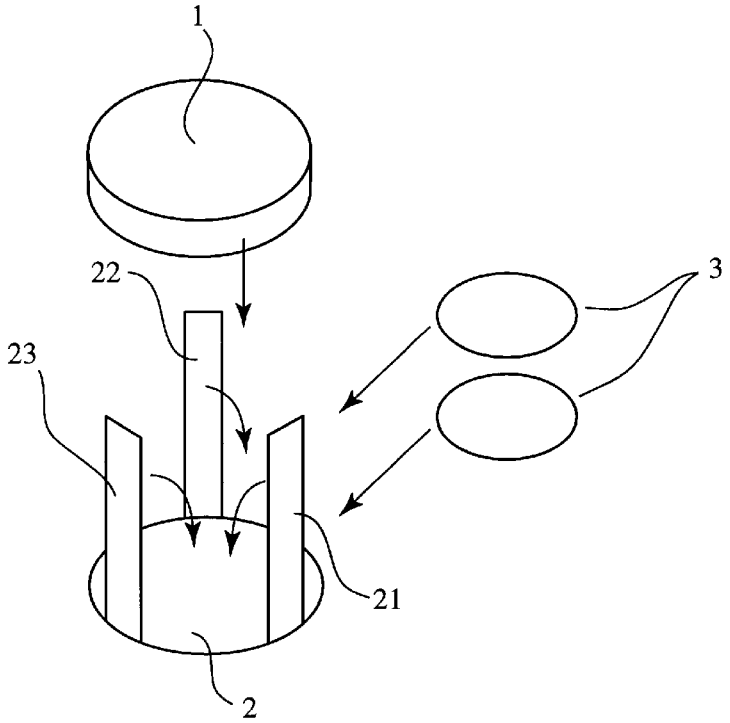
FIG. 6(a) PRIOR ART
FIGS. 6(*a*) and 6(*b*) are schematic illustrations showing the respective elements and the construction of a conventional conductor assembly.
Figure 6B:
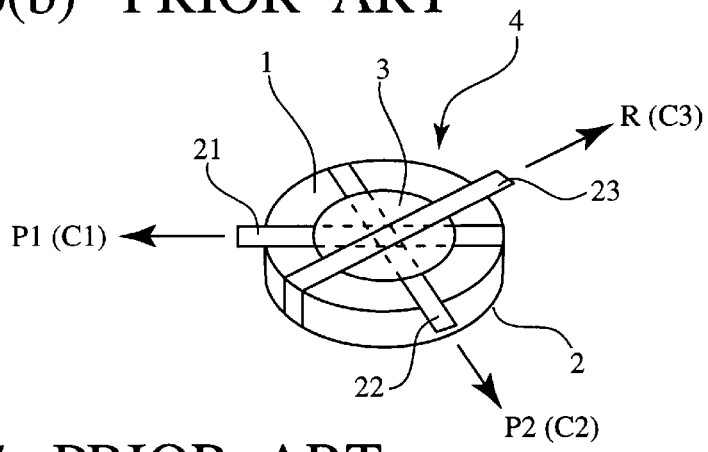
FIG. 6(b) PRIOR ART
Figure 7:
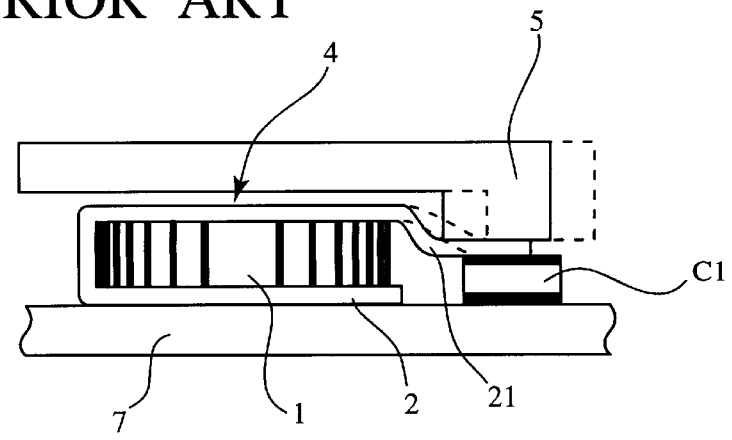
FIG. 7 PRIOR ART
FIG. 7 is a schematic illustration showing the connection of a bent strip electrode of the conventional conductor assembly of FIG. 6(*b*) to the top surface of a capacitor.

In accordance with the method described above, isolators having the conventional conductor assembly 4 as shown in FIG. 6(*b*) and isolators having the conductor assembly 20 of the present invention, 20 products for each, were produced. The insertion loss, the isolation and the voltage standing wave ratio (VSWR) were measured on the isolators in the same manner as in the preferred embodiment 1.

In Table 2, the variation in peak frequency (3σ, wherein σ is standard deviation) of the measured characteristics between the isolators are shown. From a statistical point of view, the deviation of sample and the deviation of population are not the same, but the difference therebetween is minimized with increasing sample size. Since the sample size is 20 in the above measurements, the determined variation is considered to represent the variation of the population.

TABLE 2

| | Insertion Loss (MHz) | Isolation (MHz) | VSWR (in) (MHz) | VSWR (out) (MHz) |
|---|---|---|---|---|
| Invention | 0.92 | 13.18 | 14.38 | 10.13 |
| Comparison | 3.68 | 17.88 | 15.54 | 16.39 |

As seen from Table 2, the isolators of the present invention, in which the end portions of the strip electrodes were so shaped that the lower surface thereof extended horizontally in coplanar relationship to the top surface of the respective capacitors to be connected, showed a reduced product-to-product variation in the peak frequency in any of the measured characteristics.

Although, described above were results on the isolators, the same results were obtained on the circulators.

PREFERRED EMBODIMENT 3

In this embodiment, unlike the preferred embodiment 2, the end portion of each strip electrode is not further bent and left to extend horizontally in contact with the top surface of the garnet disk 25, as shown in FIG. 1(*b*). Each capacitor to be connected to the strip electrode is disposed so that the top surface thereof is in coplanar relationship to the lower surface of the strip electrode.

The assembly of the conductor assembly will be described below. As shown in FIG. 1(*a*) or FIG. 3(*a*), a garnet disk 25 is put on a shield disk 2 which has, as the integral parts thereof, strip electrodes 21, 22, 23 extend therefrom radially. Then, one of the strip electrodes, for example, the strip electrode 21 is bent at the periphery of the bottom surface of the garnet disk 25 so as to extend upward in contact with the circumferential surface of the garnet disk 25, and then further bent inside at the periphery of the top surface of the garnet disk 25 so as to extend horizontally in contact with the top surface of the garnet disk 25 while passing the center of the top surface thereof. Then, an insulating sheet 31, for example, an adhesive polyimide circular sheet, is disposed on the bent strip electrode 21 so as to closely fix it onto the top surface of the garnet disk 25. The same bending process is repeated on strip electrodes 22, 23 while respectively disposing insulating sheets 32, 33 thereon.

The conductor assembly thus produced is then electrically connected to capacitors C1 to C3 and the resistor R in a resin case. The resin case has a recessed ground electrode which receives the conductor assembly. The shield disk 2 is soldered to the ground electrode. The capacitors C1 to C3 and the resistor R are received by respective rectangular recessed electrodes, and one of the terminals thereof is soldered to the respective recessed electrodes. Input/output terminals P1 and P2 connected to the respective recessed electrodes for the capacitors C1 and C2 are formed on the bottom surface of the resin case. The recessed ground electrode and the rectangular recessed electrodes are so formed that the top surface of the capacitors and resistor, when disposed into the rectangular recessed electrodes, is in coplanar relationship to the lower surface of the end portion of the strip electrode to be connected.

The horizontally extending end portions of the strip electrodes 21, 22, 23 are respectively soldered to the capacitors C1, C2, C3. As a result, the strip electrodes 21, 22 are respectively connected to the ports P1, P2 through the matching circuits each including capacitor C1 or C2, and the strip electrode 23 is connected to the resistor R through the matching circuit including the capacitor C3. Thus, each of the strip electrodes 21, 22, 23 is wound around the garnet disk 25 in contact with the circumferential surface and the top surface of the garnet disk 25, and the end portion of each strip electrode is connected to the capacitor with the end portion extending horizontally. With the above structure, the product-to-product variation in the contact length can be reduced. Therefore, the inductance of the strip electrodes is made constant between the products to minimize the variation in the electrical characteristics.

The non-reciprocal circuit element of the present invention may be characterized by each of the characteristic features of the above preferred embodiments 1–3, or may be characterized by a combination of the characteristic feature of the preferred embodiment 1 and the characteristic feature of the preferred embodiment 2 or 3.

As described above, since the conductor assembly of the present invention is assembled using insulating sheets with a specific thickness, the resultant non-reciprocal circuit element has improved electrical characteristics in the insertion loss, the isolation and the return loss.

In addition, the scattering in the inductance of the strip electrode among the products has been eliminated by shaping the end portion of the strip electrode so that the lower surface of the strip electrode extends horizontally in coplanar relationship to the top surface of the capacitor. This minimizes the product-to-product variation in the peak frequency of the insertion loss, the isolation and VSWR.

Also, the use of adhesive insulating sheets further improves the electrical characteristics of the non-reciprocal circuit element because the crossing angle between the strip electrodes is prevented from changing during the assembly and the use of the non-reciprocal circuit element.

What is claimed is:

1. A non-reciprocal circuit element for transmitting a high-frequency signal of microwave band in one direction, comprising:

a conductor assembly comprising a ferrite disk put on a shield disk being grounded and a plurality of strip electrodes disposed so as to extend horizontally on the top surface of said ferrite disk, one end of each strip electrode being connected to said shield disk, and said plurality of strip electrodes crossing each other at the same crossing angles at a center of said top surface of said ferrite disk and being insulated from each other by an insulating sheet disposed between vertically adjacent strip electrodes;

a magnet disposed so as to apply DC magnetic field to said ferrite disk in an axial direction thereof;

a plurality of capacitors, each being connected to the other end of each strip electrode; and an upper yoke and a lower yoke for receiving therein said conductor assembly, said magnet and said plurality of capacitors;

wherein the insulating sheet used for insulating said plurality of strip electrodes comprises a substrate having a thickness of larger than 12.5 $\mu$m and not larger than 65 $\mu$m, a total thickness of said insulating sheet being larger than 25 $\mu$m and not larger than 65 $\mu$m.

2. The non-reciprocal circuit element according to claim 1, wherein said insulating sheet is adhesive and further disposed on the uppermost strip electrode.

3. The non-reciprocal circuit element according to claim 1, wherein said non-reciprocal circuit element is an isolator having an insertion loss of 0.45 dB or less, an isolation of 18 dB or more and a return loss of 17 dB or more, each in terms of absolute value, when measured on a signal of 1.44 GHz.

4. The non-reciprocal circuit element according to claim 1, wherein an end portion of each strip electrode is bent at a periphery of the top surface of said ferrite disk so as to extend downward in contact with the circumferential surface of said ferrite disk, and further bent so as to extend horizontally in coplanar relationship to the top surface of said capacitor to be connected.

5. The non-reciprocal circuit element according to claim 4, wherein a notch is formed in each strip electrode at a position at which each strip electrode is bent so as to extend horizontally in coplanar relationship to the top surface of said capacitor to be connected.

6. The non-reciprocal circuit element according to claim 1, wherein said capacitor is disposed so that the top surface thereof is in coplanar relationship to the lower surface of an end portion of each strip electrode to be connected.

7. The non-reciprocal circuit element according to claim 1, wherein said plurality of strip electrodes radially extend from said shield disk as integral part of said shield disk and bent so as to surround said ferrite disk in contact with the circumferential surface and the top surface of said ferrite disk.

8. The non-reciprocal circuit element according to claim 7, wherein each strip electrode is bent at a periphery of the lower surface of said ferrite disk so as to extend upward in contact with the circumferential surface of said ferrite disk, then bent at a periphery of the top surface of said ferrite disk so as to extend horizontally in contact with the top surface of said ferrite disk, then bent at another periphery of the top surface of said ferrite disk so as to extend downward in contact with the circumferential surface of said ferrite disk, and finally bent so as to extend horizontally in coplanar relationship to the top surface of said capacitor to be connected.

9. The non-reciprocal circuit element according to claim 7, wherein each strip electrode is bent at a periphery of the lower surface of said ferrite disk so as to extend upward in contact with the circumferential surface of said ferrite disk, and bent at a periphery of the top surface of said ferrite disk so as to extend horizontally in contact with the top surface of said ferrite disk; and wherein said capacitor is disposed so that the top surface thereof is in coplanar relationship to the lower surface of an end portion of the horizontally extending strip electrode to be connected.

10. The non-reciprocal circuit element of claim 1, wherein said insulating sheet further comprises an adhesive layer.

11. A non-reciprocal circuit element for transmitting a high-frequency signal of microwave band in one direction, comprising:

a conductor assembly comprising a ferrite disk put on a shield disk being grounded and a plurality of strip electrodes disposed so as to extend horizontally on the top surface of said ferrite disk, one end of each strip electrode being connected to said shield disk, and said plurality of strip electrodes crossing each other at the same crossing angles at a center of said top surface of said ferrite disk and being insulated from each other by an insulating sheet disposed between vertically adjacent strip electrodes;

a magnet disposed so as to apply DC magnetic field to said ferrite disk in an axial direction thereof;

a plurality of capacitors, each being connected to the other end of each strip electrode; and an upper yoke and a lower yoke for receiving therein said conductor assembly, said magnet and said plurality of capacitors;

wherein a distance between any of vertically adjacent strip electrodes is larger than 12.5 $\mu$m and not larger than 65 $\mu$m at the crossing portion of said strip electrodes.

12. The non-reciprocal circuit element according to claim 11, wherein said insulating sheet is adhesive and further disposed on the uppermost strip electrode.

13. The non-reciprocal circuit element according to claim 11, wherein said non-reciprocal circuit element is an isolator having an insertion loss of 0.45 dB or less, an isolation of 18 dB or more and a return loss of 17 dB or more, each in terms of absolute value, when measured on a signal of 1.44 GHz.

14. The non-reciprocal circuit element according to claim 11, wherein an end portion of each strip electrode is bent at a periphery of the top surface of said ferrite disk so as to extend downward in contact with the circumferential surface of said ferrite disk, and further bent so as to extend horizontally in coplanar relationship to the top surface of said capacitor to be connected.

15. The non-reciprocal circuit element according to claim 14, wherein a notch is formed in each strip electrode at a position at which each strip electrode is bent so as to extend horizontally in coplanar relationship to the top surface of said capacitor to be connected.

16. The non-reciprocal circuit element according to claim 11, wherein said capacitor is disposed so that the top surface thereof is in coplanar relationship to the lower surface of an end portion of each strip electrode to be connected.

17. The non-reciprocal circuit element according to claim 11, wherein said plurality of strip electrodes radially extend from said shield disk as integral part of said shield disk and bent so as to surround said ferrite disk in contact with the circumferential surface and the top surface of said ferrite disk.

18. The non-reciprocal circuit element according to claim 17, wherein each strip electrode is bent at a periphery of the lower surface of said ferrite disk so as to extend upward in contact with the circumferential surface of said ferrite disk, then bent at a periphery of the top surface of said ferrite disk so as to extend horizontally in contact with the top surface of said ferrite disk, then bent at another periphery of the top surface of said ferrite disk so as to extend downward in contact with the circumferential surface of said ferrite disk, and finally bent so as to extend horizontally in coplanar relationship to the top surface of said capacitor to be connected.

19. The non-reciprocal circuit element according to claim 17, wherein each strip electrode is bent at a periphery of the lower surface of said ferrite disk so as to extend upward in contact with the circumferential surface of said ferrite disk, and bent at a periphery of the top surface of said ferrite disk so as to extend horizontally in contact with the top surface of said ferrite disk; and wherein said capacitor is disposed so that the top surface thereof is in coplanar relationship to the lower surface of an end portion of the horizontally extending strip electrode to be connected.

* * * * *